US005133576A

United States Patent [19]

Barnhill

[11] Patent Number: 5,133,576

[45] Date of Patent: Jul. 28, 1992

[54] CARBIDE COATED BLAST TUBE CONSTRUCTION FOR USE IN OIL AND GAS WELL COMPLETION ACROSS PERFORATIONS

[76] Inventor: W. J. Barnhill, P.O. Box 3580, Houma, La. 70361

[21] Appl. No.: 661,821

[22] Filed: Feb. 28, 1991

[51] Int. Cl.[5] ..... F16L 58/04

[52] U.S. Cl. ..... 285/39; 166/902; 138/DIG. 6; 285/55; 285/390

[58] Field of Search ..... 285/45, 39, 55, 333, 285/390; 166/902; 138/143, 146, DIG. 6

[56] References Cited

U.S. PATENT DOCUMENTS

| | | | |
|---|---|---|---|
| 1,253,149 | 1/1918 | Childers | 285/333 |
| 1,344,774 | 6/1920 | Stafford | 285/333 |
| 1,349,518 | 8/1920 | Lyle | 285/333 |
| 1,703,232 | 2/1929 | Gray | 285/390 |
| 2,059,175 | 10/1936 | Myracle | 285/390 |
| 2,084,209 | 6/1937 | McIlroy | 285/55 |
| 2,117,357 | 5/1938 | Peterson | 285/333 |
| 2,751,194 | 6/1956 | Rohrback et al. | 166/902 |
| 3,463,247 | 8/1969 | Klein | 285/333 |
| 3,989,554 | 11/1976 | Wisler | 285/333 |
| 4,688,828 | 8/1987 | Shaffer | 138/DIG. 6 |

*Primary Examiner*—Eric K. Nicholson
*Attorney, Agent, or Firm*—Pravel, Gambrell, Hewitt, Kimball & Krieger

[57] ABSTRACT

An oil well tubing joint coated with a carbide blast coating provides an elongated, hollow tubing section having an open ended continuous cylindrical internal bore and a continuous carbide coating over substantially all of the tubing section outer surface. An internally threaded connection portion of the bore at a first end of the tubing section is provided with an externally threaded connection member being positioned at the second end of the tool bore. The tubing section has a larger constant external diameter that extends over a majority of its length and three reduced external diameter portions that extend a distance from each end of the tubing, including one reduced diameter portion adjacent one end of the tubing joint and two of the reduced diameter portions being adjacent the second end of the tubing joint. The reduced diameter portions include preferably two portions having "flats" for providing power tightening surfaces that allow wrenches to grip and bite the tool body notwithstanding the carbide coating, and a third reduced external diameter section for slip relief.

8 Claims, 2 Drawing Sheets

CARBIDE COATED BLAST TUBE CONSTRUCTION FOR USE IN OIL AND GAS WELL COMPLETION ACROSS PERFORATIONS

BACKGROUND OF THE INVENTION

1. Field of the Invention

The present invention relates to downhole oil well completion tools and more particularly to an improved carbide-coated blast tubing joint construction wherein a plurality of reduced diameter sections of the tubing afford flat surfaces that are easily gripped with wrenches, and slips easily attach to the joint and wherein the joint has a continuous carbide coating for protection in use as a blast tubing joint.

2. General Background

In the completion of an oil or gas well, a plurality of joints of tubing or pipe are connected end-to-end to form an elongated string that is placed inside a cylindrical outermost casing. Each joint of pipe typically has a pair of threaded end portions which connect the joints together. A common type of tubing includes a first internally threaded end portion and a second externally threaded end portion so that an end portion of one joint threadably attaches to an end portion of an adjacent joint by a mating of the internal and external threads. The internal threaded portion is typically referred to as the "box" end portion of the tubing or the "box" connection. The externally threaded portion of the tubing is typically referred to in the art as the "pin" end portion or the "pin" connection.

Common oil and gas well tubing sections are usually of uniform cylindrical outer configuration, being generally elongated such as, for example, twenty (20) foot, thirty (30) foot, or forty (40) foot joints, and having a relatively small diameter in comparison to the length of the joint, such as, for example three (3) inches–six (6) inches in external or overall diameter. The common commercially available joints of tubing also have a cylindrical internal bore which is uniform between the end portions of the joint, thus having a uniform cylindrical or circular cross section.

Tubing must often be used in a very hostile environment such as, for example, highly abrasive environments of well completion. In these situations, it is desirable to coat the tubing with carbide, for example, so that the tubing can better withstand the environment in which it is used. It is known in the art to coat a generally uniform cylindrical section of tubing with a carbide coating for purposes of protecting that joint of tubing in its downhole hostile environment.

After an oil or gas well is drilled, the outer cylindrical well casing is perforated using a perforating gun that is positioned at a location or elevation where the well is to be produced. The perforating gun penetrates through the casing and into the surrounding formation creating several perforations over a given vertical distance. Oil, sand, or both comes into the casing through these perforations, hits the tubing at generally right angles and can have a blasting effect such as occurs in sand blasting.

A "blast joint" of heavier dimensions was designed years ago to function in a completion situation. Whereas normal tubing is about one quarter inch (¼) thick wall thickness, a typical prior art "blast joint" is about one-half inch (½) thick. The one-half inch (½) thickness is not always sufficient because the blast of material (including sand, oil, and formation material) coming from the perforations and hitting the tubing can still mechanically erode or cut it and wash it out.

SUMMARY OF THE INVENTION

The present invention provides an improved carbide coated blast tube construction for use in oil and gas wells wherein an elongated, hollow tubing section is provided having an open ended continuous cylindrical internal bore, and a continuous carbide coating over substantially all of the external surface of the tubing section.

The benefits of coating a joint of tubing with carbide, for example, create problems in the handling of that particular joint of tubing. The carbide coating is very, very hard and presents a problem in handling the tubing with wrenches, slips, and other tools at the well head or well surface area.

To be able to run the improved joint of the present invention into a well, the operators have to set the slips on it. An undercut of about two (2) feet long is provided where the slips are set. An operator sets the slips in the rotary table on the rig and then the wrench flats on top of the joint affords a position to grip with global wrenches when making up two joints.

Therefore, it is an object of the present invention to provide an improved carbide coated blast tubing joint that can withstand the rigors of the downhole environment including highly corrosive and/or high temperature environments, yet which affords improved handling characteristics for interfacing the joint with wrenches, slips, and the like.

The improved tubing of the present invention is provided with an internally threaded connection end portion at a first end of the tubing section and an externally threaded connection end portion of the tubing at its second end portion. The tubing section has a larger constant external diameter portion that extends over a majority of the length of the section and includes an end portion of the larger external diameter adjacent the first and the second end portions of the tubing section, namely immediately adjacent the pin and box connection end portions thereof.

The tubing section also provides a plurality of reduced external diameter portions that extend a distance between the end portions of the joint which are of the larger external diameter and extend a distance toward a distance toward the central portion of the tubing section, terminating short of the central portion of the tubing section.

In the preferred embodiment, at least one of the reduced external diameter sections is defined by a plurality of generally flat intersecting surfaces. These flats or flat surfaces afford gripping surfaces that are easily engaged by wrenches so that the wrench can adequately make up and break occurs when tubing joints have a very hard protective coating, such as a carbide coating.

In the preferred embodiment, the reduced external diameter sections include at least one reduced diameter section that carries four generally flat intersecting surfaces, spaced about 90° apart.

In the preferred embodiment, two of the reduced external diameter sections carry a plurality of generally flat intersecting surfaces and a third reduced diameter section is positioned between one of the plurality of flat surfaces and the center of the tubing joint.

In the preferred embodiment, the plurality of reduced external diameter sections are defined by a plurality of generally flat intersecting surfaces spaced within about two feet of the end of each end portion of the elongated hollow tubing section, so that the wrenches can be placed very close to the connection ends of the joints during use.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figures 1, 3:
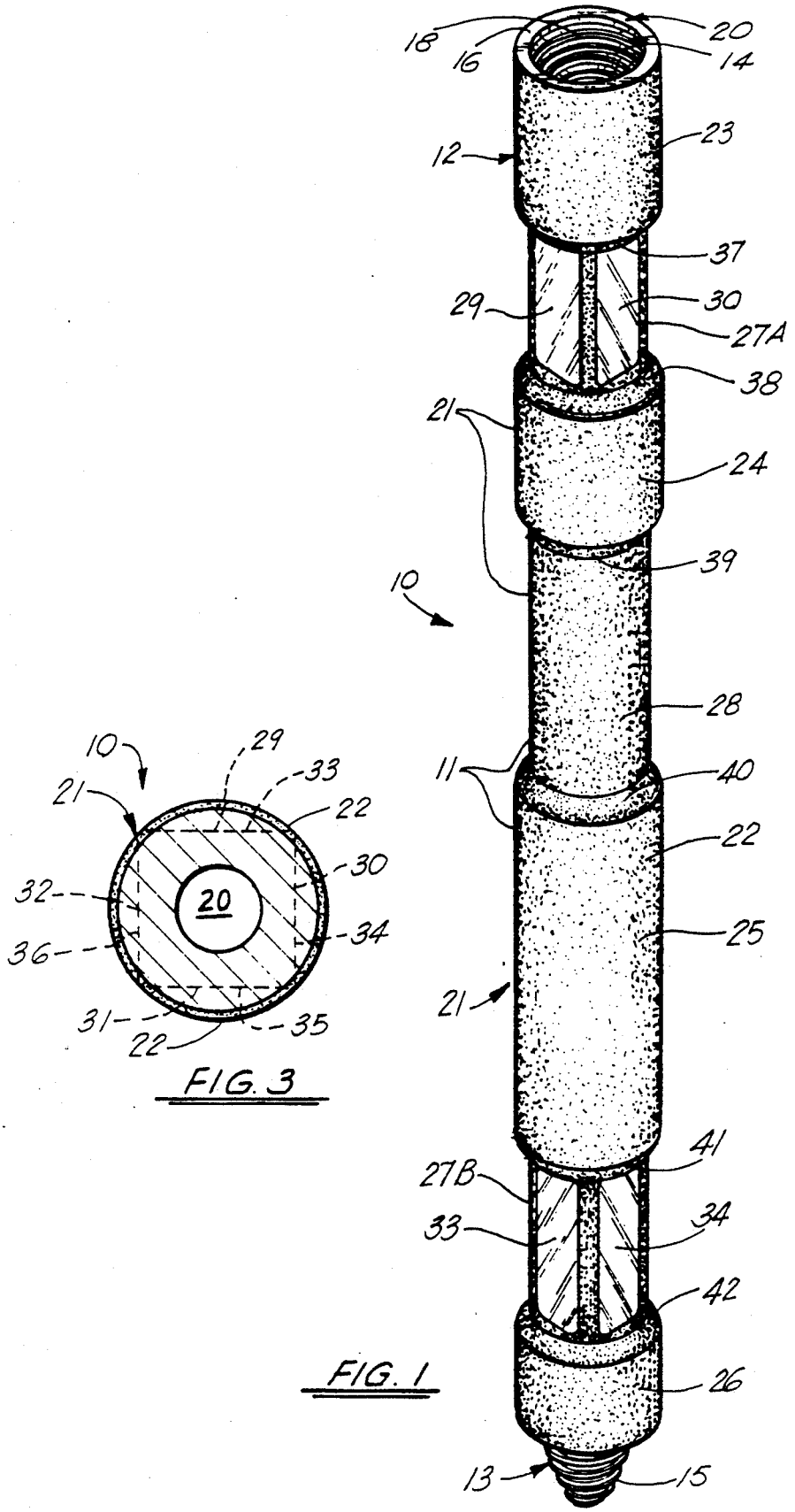
FIG. 1 is a schematic perspective view of the preferred embodiment of the apparatus of the present invention.
FIG. 3 is a cross-section view of the preferred embodiment of the apparatus of the present invention.
Figure 2:
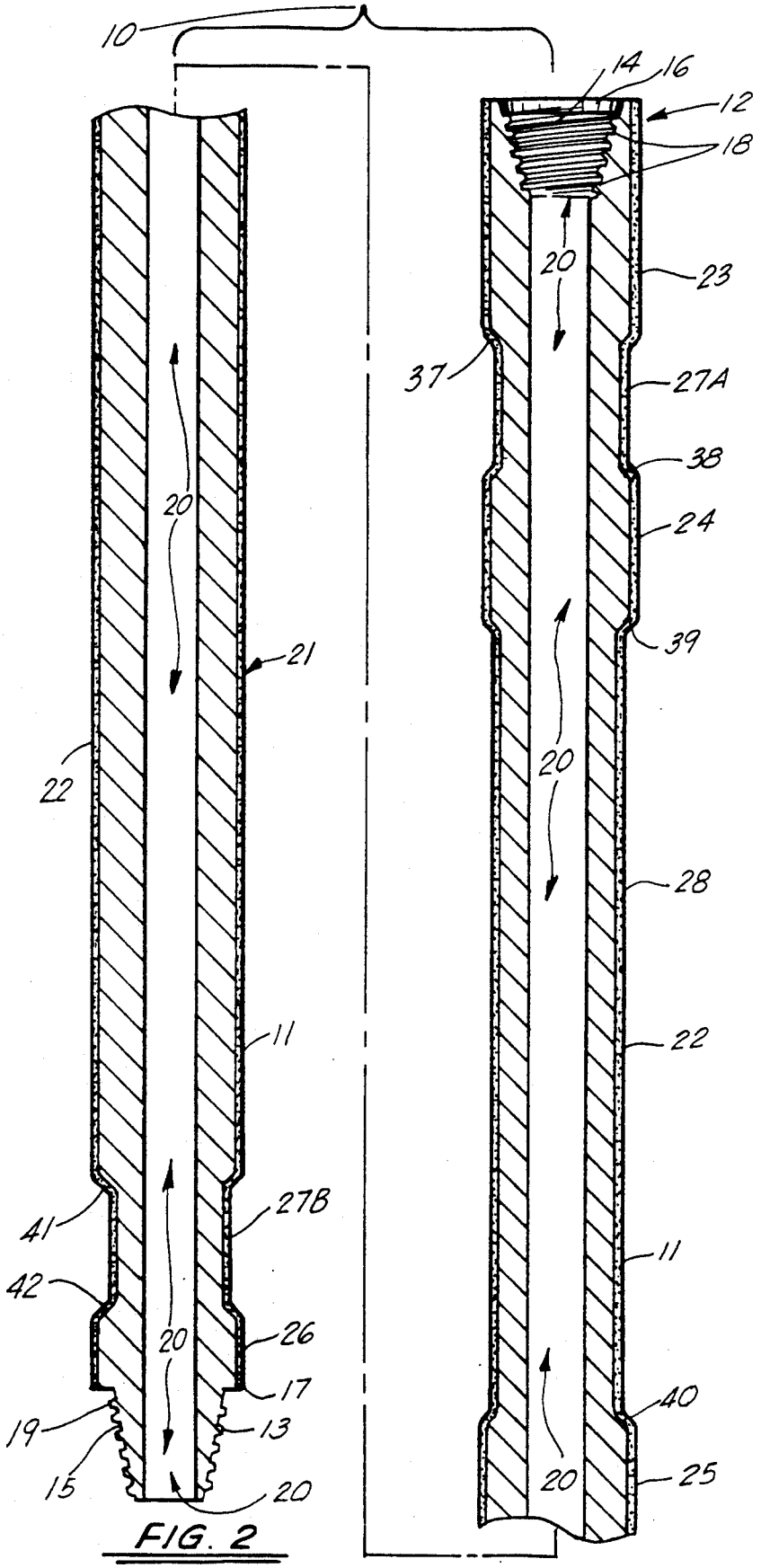
FIG. 2 is a sectional view of the preferred embodiment of the apparatus of the present invention.

FIGS. 1-2 illustrate the preferred embodiment of the apparatus of the present invention designated generally by the numeral 10. In FIGS. 1 and 2, carbide blast tubing member 10 includes an elongated hollow tubing section 11 having end portions 12, 13. End 12 is a "box" end portion having internal threads 14, while the end portion 13 is a "pin" end portion having external threads 15. A generally flat end face 16 of the box 13 end communicates with longitudinally extending open bore 20. Similarly, end face 17 of pin 13 end portion of tubing section 11 communicates with longitudinally extending open ended bore 20.

The outer surface configuration 19 of external threads 15 is generally frustro-conically shaped and corresponds to the internal surface configuration 18 of box 12 internal threads 14. Between box 12 and pin 13 end portions, longitudinally extending bore 20 is substantially cylindrical and of uniform cylindrical diameter and section, as shown in FIGS. 1 and 2.

The outer surface 21 configuration and thus the cross section of tubing section 11 is not uniform, as can be seen from the sectional view of FIG. 2. Outer surface 21 includes a substantially continuous carbide coating 22 that extends between face 16 and end face 17. The outer surface 21 of tubing section 11 includes a plurality of enlarged diameter portions 23-26. Enlarged diameter section 23 is adjacent and surrounds box 12 end portion of tubing section 11.

The enlarged diameter section 23 provides a substantially uniform external cylindrical external shape of uniform diameter. Similarly, the external enlarged diameter of section 24, 25 and 26 are of the same external diameter as the section 23, and are each cylindrically shaped.

A plurality of smaller diameter external sections 26-28 include a first external diameter section 27A adjacent box end 12 of tubing section The reduced external diameter section 26 carries a plurality of flat surfaces 29-32. Each flat surface 29-32 is generally rectangular in configuration, having the configuration shown in FIG. 1.

Reduced external diameter section 27B also includes four (4) "flats", or flat surfaces 33-36. These flat surfaces 29-32 of reduced external diameter section 27A and 33-36 of reduced external diameter section 27B provide power tightening surfaces that allow wrenches to attach directly to the flat surfaces 29-32 or 33-36 during a making up or breaking apart of pair of adjacent carbide coated tubing joint members 10. The flat surfaces afford preferably four circumferentially spaced-apart flat surfaces 29-32 and 33-36. The surfaces 29-32 are positioned approximately −90° apart, as shown in FIG. 2. The surfaces 33-36 are also circumferentially apart approximately 90 degrees.

The reduced external diameter section 28 is generally cylindrical and shaped similarly to the enlarged external diameter sections 23-26 but of a smaller external diameter, as can be seen in FIG. 1. The reduced external diameter section 27 is provided for slip relief.

A beveled annular surface 37 defines a connection between the enlarged external diameter section 23 and the reduced external diameter section 27A. Similarly, beveled annular surfaces 38, 39, 40, 41, and 42 are provided as connections between the various outer surfaces of enlarged diameter and reduced diameter sections, as shown in FIG. 1.

In summary, the beveled annular surface 38 forms a connection between the reduced external diameter section 27A and the enlarged external diameter section 24. Beveled annular surface 39 extends between enlarged external diameter section 24 and reduced external diameter section 28. Beveled annular surface 40 forms a connection between reduced external diameter section 28 and enlarged external diameter section 25 while the reduced external diameter section 27B connects with adjacent enlarged external diameter sections 25 and 26 at beveled annular surfaces 41, 42 respectively.

The following table lists each part number and part description as used herein in the written specification, with the corresponding part numbers being designated on one or more of the drawing figures.

PARTS LIST

| PART NO. | PART DESCRIPTION |
|---|---|
| 10 | Carbide coated tube |
| 11 | Tubing section |
| 12 | End (box) |
| 13 | End (pin) |
| 14 | Internal threads |
| 15 | External threads |
| 16 | End face |
| 17 | End face |
| 18 | Surface box connector |
| 19 | Outer surface pin connector |
| 20 | Bore |
| 21 | Outer surface |
| 22 | Carbide coating |
| 23 | External, enlarged diameter section |
| 24 | External, enlarged diameter section |
| 25 | External, enlarged diameter section |
| 26 | External, enlarged diameter section |
| 27A | Reduced, external diameter section |
| 27B | Reduced, external diameter section |
| 28 | Reduced, external diameter section |
| 29 | Flat |
| 30 | Flat |
| 31 | Flat |
| 32 | Flat |
| 33 | Flat surface |
| 34 | Flat surface |
| 35 | Flat surface |
| 36 | Flat surface |
| 37 | Beveled annular surface |
| 38 | Beveled annular surface |
| 39 | Beveled annular surface |
| 40 | Beveled annular surface |
| 41 | Beveled annular surface |
| 42 | Beveled annular surface |

The carbide coating can be a tungsten carbide coating which is made of tungsten carbide with a chrome, nickel, boron matrix. As an example, the tungsten carbide can be 35% to 60% of the coating matrix while the chrome, nickel, boron matrix can be a mixture of 35%-65% of the overall coating. As an example, the coating could be 35% tungsten carbide and 65% chrome, nickel, boron matrix with the chrome being 21%, the nickel being 67%, and the boron being 12%. One example of an optimum percentage for abrasive wear has been found to be 50% tungsten carbide and 50% chrome, nickel, boron matrix with the chrome being 21%, the nickel being 67%, and the boron being 12%. The above combination has been found to be best for abrasive wear as well as maintaining ductility which is needed for ease of installation into wells. The tungsten carbide coating is preferably spray welded onto the 4140 steel base material. It is then fused at high temperature (preferably 1700°-1900° Fahrenheit) to the base metal with a slow cool down process. This finished blast tube is then taken to a machine shop where threads are put onto the base metal 4140 material for joining blast tubes together or to other pipe.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An oil and gas well tubing joint, comprising:

(a) an elongated, hollow tubing section having an open ended continuous cylindrical internal bore, and a continuous carbide coating over substantially all of the tubing section outer surface;

(b) an internally threaded connection end portion of the bore at a first end of the tubing section;

(c) an externally threaded connection end portion at a second end of the tool bore;

(d) the tubing section having a plurality of spaced apart larger constant external diameter portions that extend in combination over a majority of the length of the section and including portions of said larger external diameter positioned adjacent the first and second end portions of the tubing section;

(e) the tubing section having a plurality of reduced external diameter portions that extend a distance between said end portions of larger external diameter and toward the central portion of the tubing section;

(f) wherein a first of said reduced external diameter sections is defined by a plurality of generally flat intersecting surfaces positioned adjacent one of said connection end portions;

(g) wherein a second of said reduced diameter sections is cylindrical and spaced away from the connection end portions, and abutting two opposite larger diameter sections; and (h) a plurality of beveled annular surfaces defining a plurality of interfaces between adjacent larger diameter and smaller diameter portions.

2. The apparatus of claim 1 wherein there are three of said reduced external diameter portions.

3. The apparatus of claim 1 wherein one of said reduced external diameter sections is defined by a plurality of four generally flat external surfaces.

4. The apparatus of claim 1 wherein at least two of said reduced external diameter sections are each defined by a plurality of generally flat intersecting surfaces.

5. The apparatus of claim 4 wherein said plurality of generally flat intersecting surfaces are spaced within about eighteen inches of the end of said tubing joint.

6. The apparatus of claim 4 wherein said reduced external diameter portions defined by the plurality of generally flat intersecting surfaces are each spaced within about two feet of the end of each end portion of said elongated hollow tubing section.

7. The apparatus of claim 1 wherein there are three of said plurality of reduced external diameter portions including a pair of reduced diameter portions spaced within about two feet of each end of said elongated hollow tubing section, and a third reduced diameter portion that is longer than said reduced diameter sections defined by the plurality of generally flat intersecting surfaces, said third reduced diameter section being spaced away from the center of said tubing section measured from the end portions, closer to one of said reduced external diameter sections defined by the plurality of generally intersecting surfaces.

8. An oil well tubing joint comprising:

(a) an elongated hollow tubing section having an open ended continuous cylindrical internal bore, and a continuous carbide coating extending over the outer surface of said tubing section;

(b) an internally threaded box connection portion of said bore at a first end of the tubing section;

(c) an externally threaded pin connection portion of said bore at a second end portion of the longitudinal bore;

(d) a tubing section having a larger constant external diameter portion that extends over a majority of the length of the section and including end portions of said larger external diameter positioned adjacent the first and second ends of the tubing section, immediately adjacent said internally threaded box connection and said externally threaded pin connection portions;

(e) the tubing section having a plurality of three reduced external diameter portions that include a combined distance between said end portions of less than one-half the overall length of said tubing section;

(f) said reduced external diameter portions including a first reduced diameter section positioned at the pin end portion of said tubing joint, a second reduced diameter portion positioned adjacent said box end portion of said tubing joint, and a third reduced diameter portion that is longer in length than said first and second reduced diameter portions, and being positioned within about two feet of one end of said tubing section.

* * * * *